United States Patent [19]

Altherr

[11] 4,422,557

[45] Dec. 27, 1983

[54] ALIGNING DRAWBAR

[75] Inventor: Russell G. Altherr, Munster, Ind.

[73] Assignee: AMSTED Industries Incorporated, Chicago, Ill.

[21] Appl. No.: 417,459

[22] Filed: Sep. 13, 1982

Related U.S. Application Data

[63] Continuation of Ser. No. 202,561, Oct. 31, 1980, abandoned.

[51] Int. Cl.[3] ..... B61G 9/20

[52] U.S. Cl. ..... 213/62 R; 105/3; 213/58; 213/69; 213/72

[58] Field of Search ..... 105/3, 4 R; 213/12, 213/14, 21, 58, 60, 62 R, 63, 64, 69–74, 75 R

[56] References Cited

U.S. PATENT DOCUMENTS

| | | | |
|---|---|---|---|
| Re. 29,011 | 10/1976 | Altherr | 213/64 |
| 87,158 | 2/1869 | Fairlie | 213/73 |
| 2,386,476 | 10/1945 | Kinne et al. | 213/14 |
| 2,545,330 | 3/1951 | Wolfe | 213/58 X |
| 3,709,376 | 1/1973 | Altherr | 213/62 R |

FOREIGN PATENT DOCUMENTS

| | | | |
|---|---|---|---|
| 1455233 | 5/1969 | Fed. Rep. of Germany | 213/64 |
| 1530209 | 8/1969 | Fed. Rep. of Germany | 213/75 R |

*Primary Examiner*—Randolph Reese

*Attorney, Agent, or Firm*—Edward J. Brosius; Fred P. Kostka

[57] ABSTRACT

A drawbar assembly comprising a drawbar and a buffing block device constructed and arranged so as to provide a turning moment which tends to align the horizontally displaced adjacent ends of the railway vehicle to which the drawbar is connected when said drawbar is operating under buff loading.

2 Claims, 11 Drawing Figures

ALIGNING DRAWBAR

This is a continuation of application Ser. No. 202,561, filed Oct. 31, 1980, now abandoned.

BACKGROUND OF THE INVENTION

1. Field of the Invention

This invention relates generally to a drawbar assembly for railway vehicles and particularly to a new and novel drawbar assembly which resists misalignment of the vehicle unit ends to which the drawbar is connected . The drawbar assembly has a substantially rigid drawbar member and a buffing block means constructed so as to provide a turning moment when operating under buff loading that tends to maintain the two horizontally displaced adjacent ends of railway vehicle units in alignment.

2. Prior Art

In present day practice, the standard length of the containers to be carried on flat bed railway cars is approximately 45 feet. Since the length of the longest flat bed car is limited to about 89 feet, it cannot accommodate to such containers. The construction of individual shorter 45 foot length flat bed cars each carrying one container is costly and inefficient because each car would require yokes and draft gear assemblies at each end. This inefficiency is particularly apparent when the flat bed cars are employed for carrying containers only and the cars are infrequently disconnected. Accordingly, it has been proposed to provide a flat car of 90 foot length including two sections or units of which the adjacent ends are connected by a simple drawbar assembly. The remote ends may be provided with the usual couplers, yokes and cushioning draft gear. The construction and the arrangement of a generally conventional drawbar assembly under buff loading tends to create forces which may jackknife the two adjacent railway car sections.

SUMMARY OF THE INVENTION

In accordance with the present invention, there is provided a drawbar assembly for railway cars which overcomes the jackknifing tendency of the railway cars as encountered heretofore. This is accomplished generally by the provision of a buffing block assembly and a drawbar which are constructed and arranged so that during buff impact they are engaged to transmit a coupling force upon the drawbar to maintain it normal to the adjacent ends of two car units.

More specifically, the opposite ends of the drawbar are connected to the ends of the car unit center sills by means of a key slot arrangement so as to permit relative limited pivotal movement of the car units relative to each other. In a buff condition, the opposite ends of the drawbar are in contact with the respective buffing blocks located in the respective adjacent car unit center sills. Buff alignment control is achieved by engaging the contacting faces of the buffing blocks with the associated ends of the drawbar so that the force on the drawbar is eccentric of the center line of the drawbar. This provides a coupling force which tends to force the drawbar into a position normal or perpendicular to the unit ends.

Other objectives, features and advantages of the invention will be apparent from the following detailed disclosure taken in conjunction with the accompanying sheets of drawings in which like parts bear like reference numerals.

DESCRIPTION OF THE PREFERRED EMBODIMENT

Figures 1, 2, 3, 4:
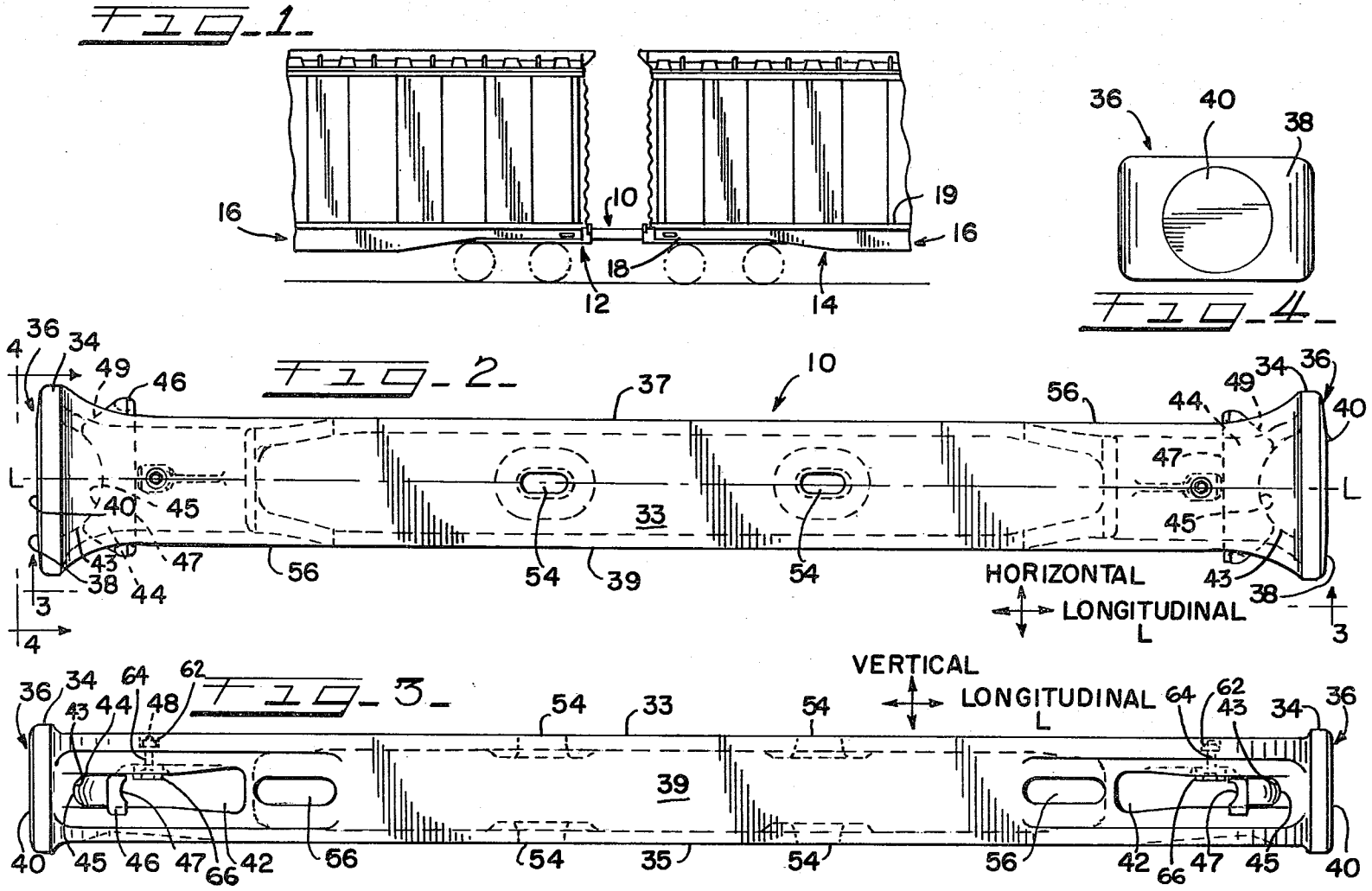
FIG. 1 is a fragmentary side elevational view of a drawbar assembly connecting the two adjacent ends of two sections of a railway car.
FIG. 2 is a top plan view of a drawbar member embodying the present invention.
FIG. 3 is a side elevational view of the drawbar member of FIG. 2.
FIG. 4 is an end elevational view of an end surface of the drawbar member taken generally along line 4—4 of FIG. 2.

Referring now to the drawings, in particular FIG. 1, there is shown a drawbar assembly 10 connecting the adjacent ends of two units 12 and 14 of a flat bed railway vehicle 16. While the drawbar assembly is shown only connecting the adjacent ends of two units of a railway car, it should be readily apparent that the units may be two independent cars and the drawbar assembly may be utilized at each end of such cars or units.

The railway vehicle units 12 and 14 may be of generally conventional structure including an underframe having a center sill 18 and flooring 19 supported thereon. Containers or semitrailers, each which may be of the standard 45 foot length, are supportable on the units 12 and 14. The remote ends of the railway vehicle 16 are provided with the usual coupler, yoke and draft gear assemblies (not shown).

Figure 6:
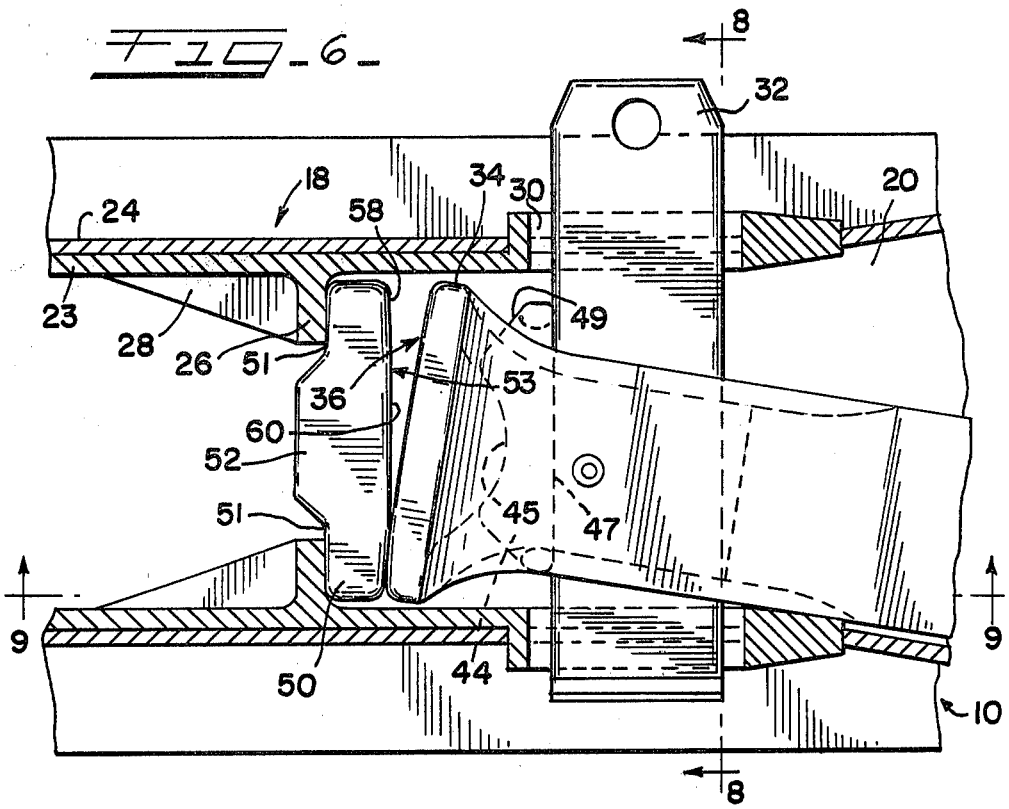
FIG. 6 is a fragmentary top plan view, partially in cross section, of a drawbar assembly showing one end of the drawbar member in contact with the buffing block shown engaged in the buff position.
Figure 8:
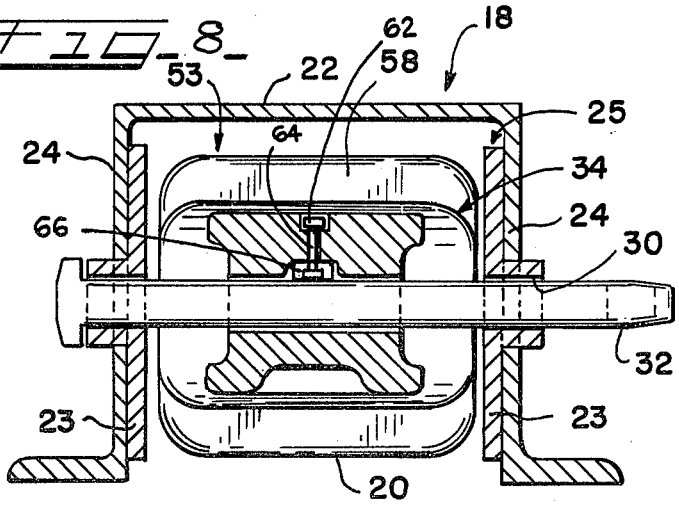
FIG. 8 is a cross-sectional view taken along the line 8—8 of FIG. 6.
Figure 10:
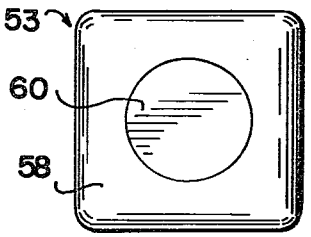
FIG. 10 is an end elevational view of a load bearing surface of the buffing block taken generally along line 10—10 of FIG. 9.
Figure 9:
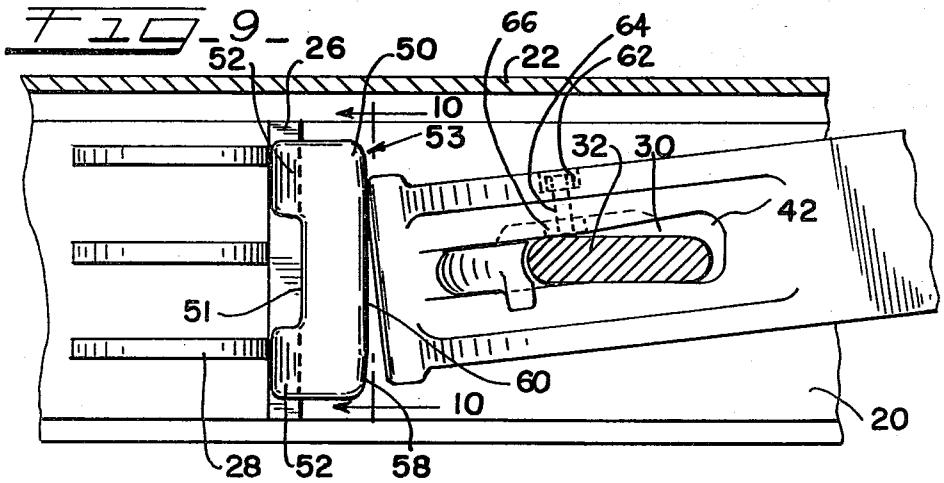
FIG. 9 is a fragmentary side elevational view taken generally along line 9—9 of FIG. 6.

The center sills 18 may each be of generally conventional hat-shaped structure along the major portion of the length thereof and provided at one end with a drawbar pocket 20 as shown in FIGS. 6, 8 and 9. The drawbar pocket 20 is defined by a top web 22 and two side webs 24. Two substantially opposed buff stops 26 are integrally formed on the side webs 23 of pocket inserts 25 welded to the side webs 24 of the center sill 18 in the drawbar pocket 20. The buff stops are reinforced by gussets 28 fixed to the sidewalls 23 of the insert 25. A portion of each side web 24 and the insert 25 defines a generally oblong-shaped keyway opening 30 along each side of the pocket 20. The size of the keyway opening 30 is generally larger than that of the cross-sectional area of a conventional horizontal key 32.

FIGS. 2 to 4 show a drawbar 10 which is made of metal and of generally rectangular cross section along its length having a top panel 33 and a bottom panel 35 and sidewalls 37 and 39. The drawbar 10 further has enlarged terminal portions 34 also of rectangular section at each end thereof. The terminal portions 34 are formed with terminal faces 36 having a generally convex spherical surface 38 and a planar circular surface 40 concentric with the longitudinal axis L—L of the drawbar.

In accordance with the present invention, the radius of curvature r of the convex spherical surface is at least half the length L of the drawbar 10 as defined by the distance between the terminal circular faces 40 at the opposite ends of the drawbar. The relationship of the radius of curvature r of the convex spherical surface 38 and the length of the drawbar L is significant for reasons which will become apparent hereinafter.

As shown in FIG. 3, portions of the sidewalls 37 and 39 adjacent to the ends of the drawbar define two aligned key slot openings 42 each being of a longitudinal wedge shape with an area larger than the cross-sectional area of a horizontal key 32. The upper and lower portions of the key slot opening form a slightly divergent angle so that the wider portion of the wedge-shaped opening is closer to the center of the drawbar and the narrower portion adjacent the terminal portion 34. The terminal portion 34 adjacent the key slot openings 42 generally includes a horizontally radially convex and vertically radially concave surface 43 so as to complementally abut front surface 45 of key bearing block 44 to be described hereinafter.

Figure 5:
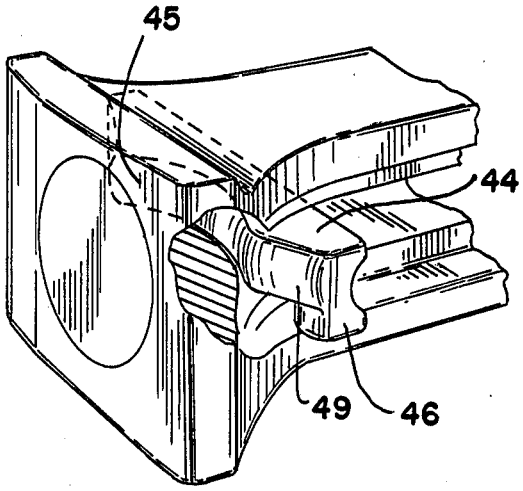
FIG. 5 is a fragmentary and perspective view of a key bearing block engaged with an end of the drawbar with some of the parts broken away to show underlying details.
Figure 7:
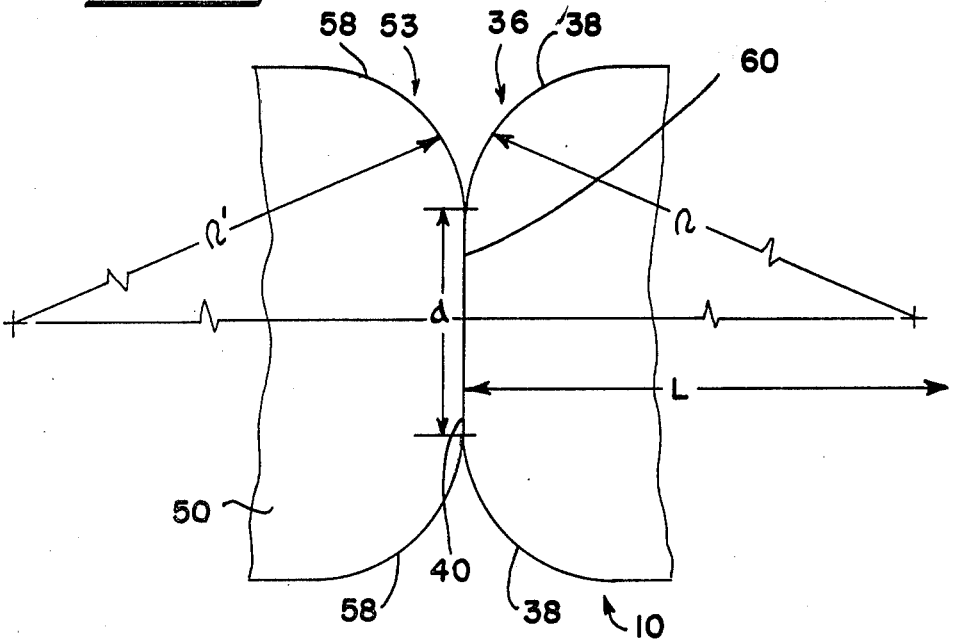
FIG. 7 is a fragmentary and schematic view of a buffing block abutting an end surface of the drawbar showing radius of curvature r and length dimension L.

A key bearing block 44 is located in the key slot opening 42 of the drawbar 10 between the end portion 34 and the horizontal key 32. The key bearing block 44 generally includes a front horizontally radially concave and vertically radially convex surface 45, a rear horizontally linear and vertically radially concave surface 47 and two inclined side edges 49 as shown in particular in FIGS. 2, 3 and 5. The front surface 45 of the key bearing block 44 is defined as the surface adjacent the terminal portion 34 of the drawbar 10 and the rear surface 47 is defined as the surface adjacent the horizontal key 32. The key bearing block 44 further has two substantially opposed downwardly extending retainer tabs 46 along its side edges 49 spaced at a distance greater than the distance between the sidewalls 37 and 39 of the drawbar 10.

FIGS. 2, 3 and 8 show generally a vertical support pad assembly 48 including a nut 62, bolt 64 and removable pad 66 arrangement through the top panel 33 of the drawbar extending into the upper portion of the key slot opening 42. The functions of the support pad assembly will be described hereinafter.

A plurality of oblong-shaped lightening apertures 54 are located on the top panel 33 and bottom panel 35 and a plurality of similarly structured lightening apertures 56 are located on the sidewalls 37 and 39 of the drawbar 10.

A buffing block 50 is disposed in the drawbar pocket 20 and is located between buff stops 26 and the terminal end portion 34 of the drawbar 10. The buffing block 50 includes a face having a stop surface 51 abutting against the buff stops 26 and a plurality of projections 52 for providing structural strength. On its opposite face the buffing block 50 is formed with a buffing surface 53 including a generally convex spherical surface 58 having a radius of curvature r′ and a planar circular surface 60 having substantially the same diameter d as the surface 40 on the drawbar 10 concentric with the longitudinal axis of the buffing block 50. The buffing block 50 is fastened to the buff stops 26 by bolts or welding. It should be noted that the buffing block can be fastened by other means, e.g. resiliently mounted to the buff stops so as to reduce free slack between the drawbar terminal face 36 and the buffing surface 53 of the buffing block 50.

Figure 11:
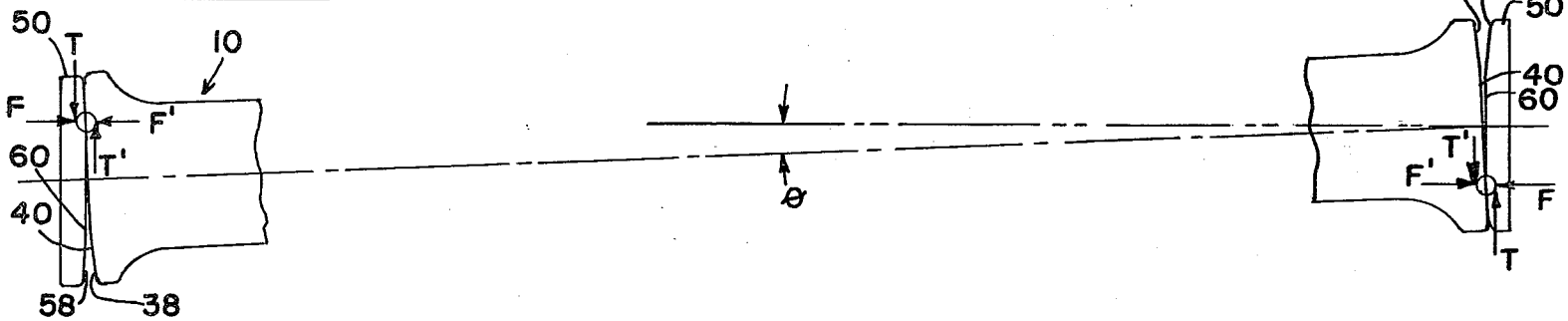
FIG. 11 is a fragmentary and schematic top plan view of the drawbar assembly and showing the forces on acting thereon in the buff position.

The drawbar 10 is held and supported in the drawbar pocket 20 of the railway car center sill 18 by a horizontal key 32 extending through the keyway opening 30 of the center sill 18 and the key slot opening 42 of the drawbar 10. When two adjacent ends of railway cars are in a buff position, the drawbar pockets 20 of car center sills 18 each having a buffing block 50 disposed therein are being pushed towards each other. The buffing surface 53 of each buffing block 50 becomes engagable with the respective terminal face 36 of the drawbar 10. Under this condition, a buff force F is exerted by the buffing block 50 on the drawbar 10 at the terminal surface 36 in a direction towards the center of curvature of the convex spherical surface 38, as FIG. 11 schematically illustrates. With the radius of curvature r of the convex spherical surface 38 at least half the length L of the drawbar, the two equal forces exerted by the buffing blocks 50 on both ends of the drawbar 10 form a coupling that continues to reduce the degree of angling between the drawbar 10 and the buffing block 50 until the longitudinal axes of the drawbar 10 and the buffing blocks 50 are aligned. As a result thereof, the adjacent railway vehicles 16 are placed in an aligned position. The optimum radii of curvature r of the convex spherical surface 38 of the drawbar 10 and r′ of the convex spherical surface 58 of the buffing block 50 are about the length L of the drawbar 10 so as to maximize horizontal angling while retaining an aligning moment.

It should be noted that during the buff loading the horizontal key 32 and key bearing block 44 remain loose in key slot opening 42. As shown in FIG. 6, the drawbar 10 is positioned at a horizontal angle with respect to the buffing block 50. This may be the result of the railway vehicles traveling on a curved track or from a yawing or pitching motion of the vehicles.

The structure of the buffing surface 53 of the buffing block 50 is substantially similar to that of the terminal surface 36 of the drawbar so as to accommodate a horizontal angle of about 9° between the longitudinal axes of the drawbar 10 and the buffing block 50.

It should be understood that in a normal buff position where the adjacent units of the railway vehicle 16 are aligned, the planar circular surface 40 of the terminal surface 36 has a sufficiently large area so as to provide ample buff bearing area to accommodate the maximum loading. For example, the diameter d of the planar circular surface 40 may be between four to seven inches.

Upon draft loading on the drawbar assembly, car center sill 18 pulls the horizontal key 32 along the edge closer to the end of the center sill 18. The opposite edge of the horizontal key 32 transmits the pulling force to the drawbar 10 through the key bearing block 44.

The rear surface 47 of the key bearing block 44 has a vertically concave groove that complementally abuts the front edge of the horizontal key 32 permitting relative vertical angling between the key and the drawbar 10. The front surface 45 of the key bearing block 44 is horizontally radially concave and complementarily abuts a portion of the drawbar 10 so that relative horizontal angling between the key bearing block 44 and the drawbar 10 is permitted. The arcuate and complementarily formed interface between the key bearing block 44 and the drawbar 10 provides a constant pressure so as to reduce excessive and uneven wear on the drawbar as well as the key bearing block, even when the drawbar 10 is at a horizontal angle with respect to the longitudinal axis of the car center sill 18.

It should be noted that the key bearing block 44 has one downwardly dependent retainer tab 46 on each side of the key bearing block 44 so as to prevent said block being inadvertently dropped out of the key slot opening 42.

Another feature of the preferred embodiment is the vertical support pad assembly 48 having a removable resilient pad 66 retained by a nut 62 and a bolt 64 which supports drawbar 10 and provides for concentricity of the cylindrical edge of key 32 and rear surface 47 of key bearing block 44. It also controls the longitudinal movement of key bearing block 44 particularly when clearance exists adjacent the key 32 when the drawbar 10 is in buff.

What is claimed is:

1. A drawbar arrangment for connecting the adjacent ends of two adjacent railway vehicles each having a drawbar pocket and stop means disposed within said drawbar pocket, a buffing block disposed in each of said pockets and engageable with said stop means upon buff impact of said vehicles, said buffing blocks each having a planar buffing surface surrounded by a convex surface, and an elongated drawbar having opposite ends extending into respective ones of said drawbar pockets, key means connecting said opposite ends of said drawbar in said drawbar pockets, said drawbar ends each having a partially spherical surface and a concentric planar surface normal to the longitudinal axis of said drawbar, said spherical surface having a radius of curvature greater than one-half the length of said drawbar and the center of curvature thereof disposed on the longitudinal axis of said drawbar whereby when said railway vehicles are in buff condition and longitudinally axially aligned said drawbar planar surface and said buffing block planar surface are in substantially face to face engagement with said buffing block abutting said stop means so that said buffing forces are transmitted longitudinally through said drawbar and said railway cars, and when said railway cars are in buff condition and out of longitudinal axial alignment said drawbar spherical surface and said buffing block convex surface are in engagement with said buffing block abutting said stop means so as to impose said buff forces on said drawer ends on opposite sides of said longitudinal axis of said drawbar to cause said drawbar to become aligned with the longitudinal axes of said vehicles and simultaneously to exert opposing forces on said adjacent vehicles to cause the railway vehicles to become longitudinally aligned.

2. The invention as defined in claim 1 wherein said radius of curvature of said spherical drawbar ends each is substantially equal to the length of said drawbar.

* * * * *